US007240715B2

(12) United States Patent
Hoffmann

(10) Patent No.: US 7,240,715 B2
(45) Date of Patent: Jul. 10, 2007

(54) LIMIT STOP FOR COVERINGS FOR ARCHITECTURAL OPENINGS

(75) Inventor: Brian M. Hoffmann, Louisville, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 363 days.

(21) Appl. No.: 11/021,921

(22) Filed: Dec. 22, 2004

(65) Prior Publication Data

US 2005/0139329 A1 Jun. 30, 2005

Related U.S. Application Data

(60) Provisional application No. 60/532,351, filed on Dec. 24, 2003.

(51) Int. Cl.
*E06B 9/08* (2006.01)

(52) U.S. Cl. ..... 160/120; 160/84.05; 248/291.1; 248/292.12

(58) Field of Classification Search ..... 160/168.1 P, 160/176.1 P, 188, 310, 89, 121.1, 300, 301, 160/302, 303, 291, 307; 248/291.1, 292.12, 248/292.13

See application file for complete search history.

(56) References Cited

U.S. PATENT DOCUMENTS

| | | | | |
|---|---|---|---|---|
| 4,489,974 | A * | 12/1984 | Warhol | 296/97.5 |
| 4,881,707 | A * | 11/1989 | Garfinkle | 248/222.12 |
| 5,320,154 | A * | 6/1994 | Colson et al. | 160/121.1 |
| 5,419,385 | A | 5/1995 | Vogel et al. | |
| 6,299,115 | B1 * | 10/2001 | Kovach et al. | 248/262 |
| 6,688,368 | B2 * | 2/2004 | Kovach et al. | 160/84.02 |
| 7,147,029 | B2 * | 12/2006 | Kovach et al. | 160/121.1 |

* cited by examiner

*Primary Examiner*—Blair M. Johnson
(74) *Attorney, Agent, or Firm*—Dorsey & Whitney LLP

(57) ABSTRACT

An indexed limit stop for mounting on the headrail of a covering for architectural openings is easily connected to the headrail in overlying relationship with shade material wrapped on a roller in the headrail and has two elements that are pivotally interconnected and movable between selected fixed positions. The second element includes an abutment stop for engagement with the bottom rail of the shade material when the covering is fully retracted and can be positioned such that the abutment stop is spaced from the outer wrap of shade material to avoid damage to the shade material while being desirably positioned for intercepting movement of the bottom rail to limit retracting movement of the roller.

7 Claims, 9 Drawing Sheets

46
48
42
50
58
102a
72
44
88
90

46
48
42
50
58
102b
72
44
88
90

46
48
42
50
58
102c
72
44
88
90

LIMIT STOP FOR COVERINGS FOR ARCHITECTURAL OPENINGS

CROSS-REFERENCE TO RELATED APPLICATIONS

This application claims the subject matter of U.S. provisional patent application No. 60/532,351 filed 24 Dec. 2003, which application is hereby incorporated by reference as if fully disclosed herein.

BACKGROUND OF THE INVENTION

1. Field of the Invention

The present invention relates generally to coverings for architectural openings and more specifically to a limit stop adapted to limit the retracting rotation of a roller on which a shade material is mounted.

2. Description of the Relevant Art

Generally, window coverings have various mechanical means for controlling the upper and lower positions of the fabric sheeting materials used in the covering. Such mechanical means is commonly referred to as a limit stop. The limit stop ensures that the fabric materials of the window covering do not traverse into the headrail more than intended, nor does it descend beyond the measured drop of the fabric. By way of example, window shade products generally use a ratchet and pawl device to stop the fabric from winding too far into the upper portion of the window. In another example, a ball stop may be attached to the operating cord to prevent the cord from traveling into the operating system beyond its design, thus preventing the fabric from wedging into the headrail. Regardless of the type of covering, it is beneficial to the operation of the window covering that some type of limit stop be installed in the system for the typical window covering to operate easily and efficiently regardless of whether it is an upper or lower limit stop.

In one limit stop known in the trade, first and second pivotally connected elements are utilized wherein the first element is attached to the rear edge of the headrail and the second element is pivotally connected to the first element so as to ride along the shade material wrapped about a roller. Such a limit stop has not been without problems inasmuch as the hinged connection of the two elements has an objectionable noise factor and the constant contact of the second element with the shade material as well as the repetitive raising and lowering of the shade causes soiling of the fabric where the limit stop contacts the fabric.

It is to provide an improvement in limit stops and to avoid the shortcomings of prior art limit stops that the present invention has been developed.

BRIEF SUMMARY OF THE INVENTION

The limit stop of the present invention comprises first and second elements connected together by a locking hinge. The first element is generally planar in configuration and includes a clip for attachment to the headrail of the covering to which the limit stop is mounted. The second element is pivotally connected to the first element for movement between selected fixed positions and is adapted to overlie, but not engage, a roll of shade material used in the covering. The second element is selectively positioned relative to the first element to also engage the bottom rail of the covering as the covering reaches a fully retracted position to prohibit further rotation of the roller in a retracting direction.

Other aspects, features and details of the present invention can be more completely understood by reference to the following detailed description of a preferred embodiment, taken in conjunction with the drawings and from the appended claims.

DETAILED DESCRIPTION OF THE INVENTION

Figure 1:
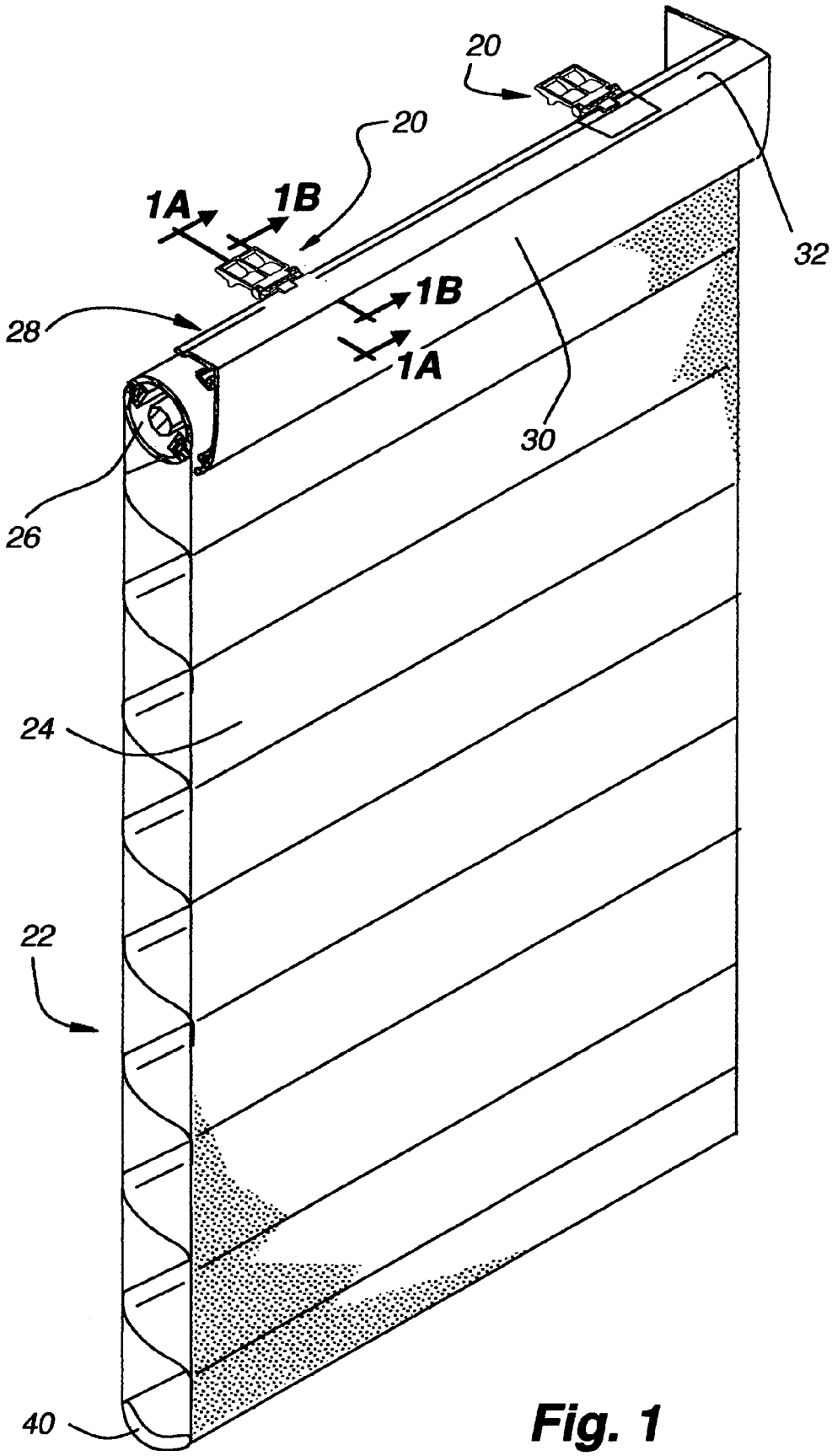
FIG. 1 is an isometric of a cellular shade material mounted on a roller in a headrail with the limit stop of the present invention mounted on the headrail.
Figure 1A:
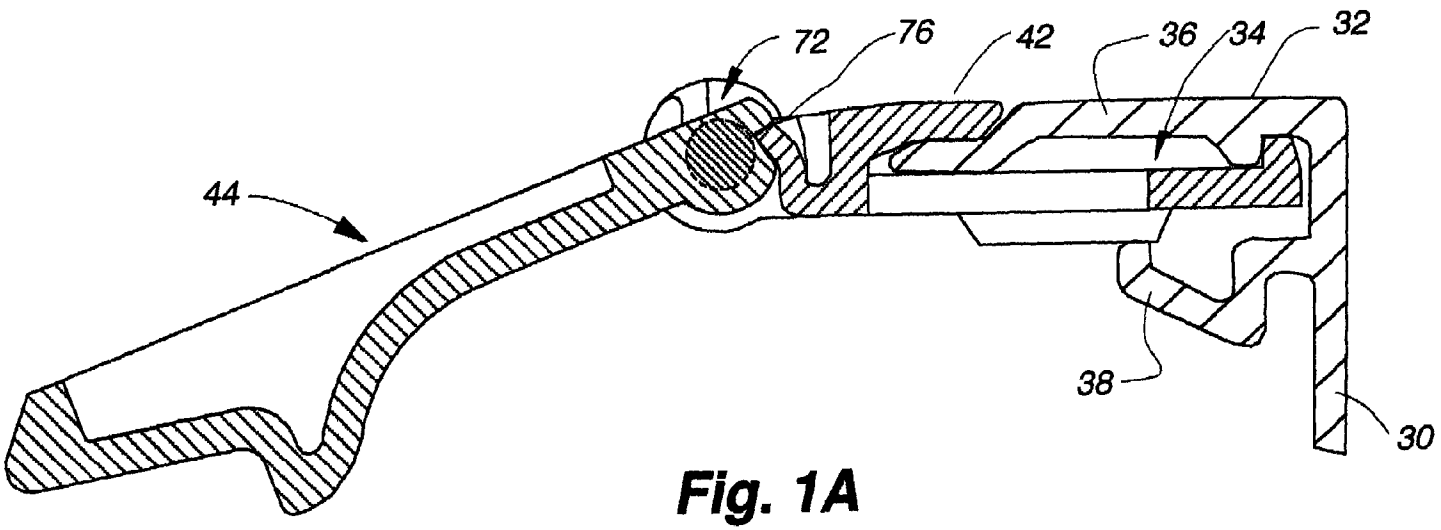
FIG. 1A is an enlarged section taken along line 1A-1A of FIG. 1.

The limit stop 20 of the present invention is seen in FIG. 1 mounted on a conventional covering 22 for an architectural opening wherein the covering is a roll-up cellular shade including a shade material 24 and a roller 26 on which the shade material can be wrapped or unwrapped in a retracted or extended position of the covering. A conventional headrail 28 (only a portion of which is illustrated) overlies the roller and shade material wrapped thereabout for aesthetic purposes and the headrail and roller are mounted on brackets not shown inasmuch as they are not pertinent to the present invention. In fact, the shade material would not need to be a cellular shade material but any shade material that is flexible and can be wrapped about a roller in a roll-up shade. The portion of the headrail illustrated is relevant to the present invention in that the limit stops 20 are mountable on this portion of the headrail.

Figure 9:
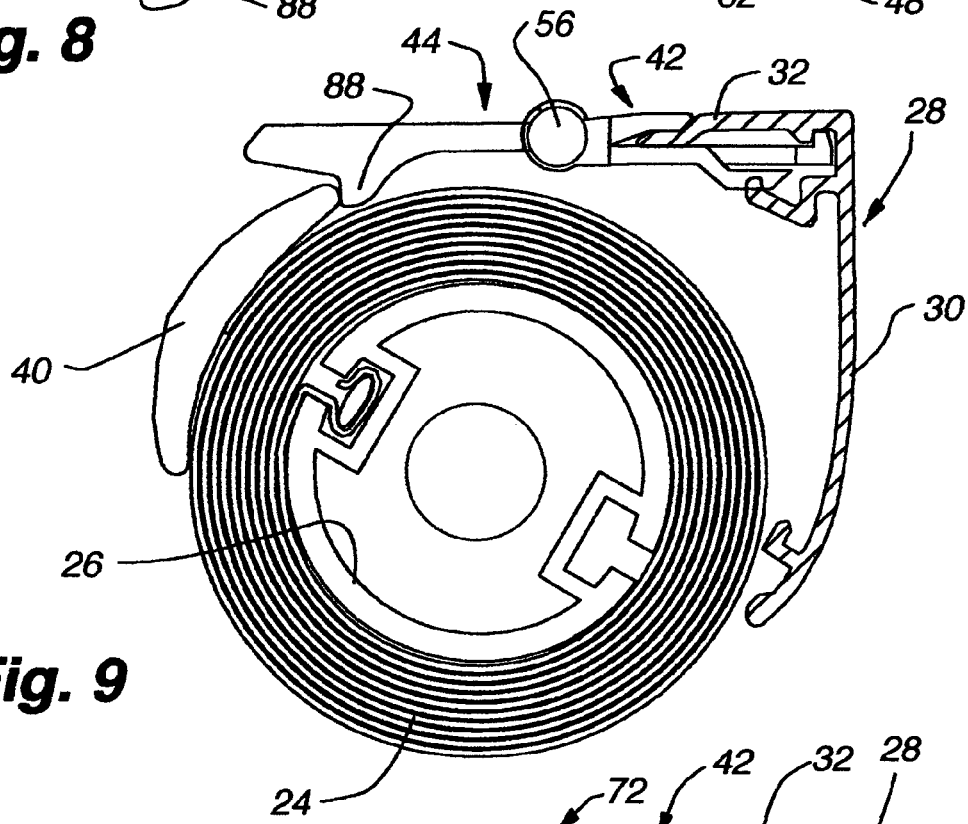
FIG. 9 is a side elevation of the limit stop mounted on a headrail and with a relatively large roll of shade material wrapped on the roller for the covering.
Figure 10:
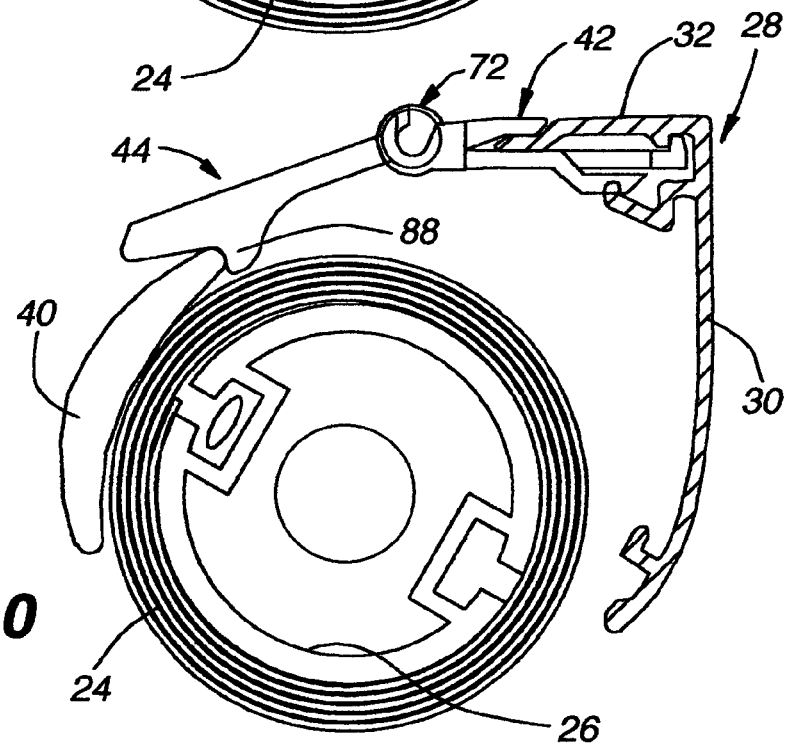
FIG. 10 is a side elevation similar to FIG. 9 with a smaller shade material wrapped on the roller.

The portion of the headrail 28 illustrated is seen best in FIGS. 1, 9, and 10 to include an arcuate main body 30 that depends downwardly from an upper horizontal shelf 32 with the arcuate main body lying in front of the roller 26 as viewed from the interior of a room in which the covering is mounted. The back edge of the horizontal shelf has a longitudinally extending notch 34 formed therein defined by an upper ledge 36 and a lower ledge 38 with the upper ledge being slightly larger than the lower edge so as to overlap the lower ledge along the rear edge of the headrail. The notch 34 in the rear edge of the headrail is adapted to cooperate with the limit stop 20 in releasably mounting the limit stop on the headrail as will be described in more detail hereafter.

The shade material 24 has a bottom rail 40 affixed to the bottom edge thereof which becomes tangentially oriented to the shade material when wrapped circumferentially about the roller 26 as best seen in FIGS. 1, 9, and 10.

The limit stop 20, as probably best seen in FIGS. 1, 1A, 1B and 2, has two component elements, a first element 42 securable to the headrail 28 and a second element 44 pivotally interconnected with the first element for movement between selected fixed positions. The first element can be seen to be of generally square planar configuration having a raised transverse rib 46 along its leading edge and a pair of downturned grip legs 48 spaced immediately rearwardly of the lip along opposite sides of the main body. A catch plate 50 is formed on a raised bar 52 along the rear edge of the main body with the catch plate overlying an opening 54 through the main body. A pair of keyed bearings 56 are provided at opposite sides of the rear edge of the first element behind the raised bar 52 and between the bearings are a plurality of lock fingers 58 inclined rearwardly and upwardly and centered across the rear of the raised bar. It should be appreciated that the entire limit stop 20 is made of a somewhat rigid material having some flexibility for a purpose to be described hereafter with many plastics, nylons, or other similar compositions being suitable.

The transverse rib 46, catch plate 50, and grip legs 48 cooperate in receiving and releasably retaining the rear notched edge of the headrail so that the limit stop is firmly and desirably mounted on the headrail to project rearwardly therefrom. The grip legs 48 are generally L-shaped with a beveled leading edge and project downwardly like a tab from the lower surface of the main body of the first element 42. The catch plate 50 on the other hand projects forwardly in vertically spaced relationship from the main body. The catch plate has a flat upper surface and a lower surface as seen best in FIGS. 11-17 which is beveled along a front edge 60, flat along an intermediate portion 62 and again beveled along an inner portion 64 so as to be relatively thick at its rear.

In connecting the first element 42 to the headrail 28 as can be appreciated by reference to FIGS. 9 and 10, the upper ledge 36 of the headrail is inserted beneath the catch plate 50 on the first element of the limit stop and as the upper ledge engages the rear beveled surface 64 of the catch plate, it is forced downwardly into a compressed relationship with the main body of the first element. The grip legs 48 overlie and are biased against the lower ledge 38 of the headrail. The transverse rib 46 along the forward edge of the first element underlies the upper ledge 36 of the headrail and biases the upper ledge upwardly while the grip legs bias the headrail downwardly so as to establish a tight or wedged grip on the headrail. The beveled leading edges of the catch plate and the grip legs facilitate an easy insertion of the first element into the notch 34 in the rear edge of the headrail while the front wall of the raised bar 52 exposed beneath the catch plate limits the distance in which the headrail can be inserted and wedgedly retained in the first element.

Figure 2:
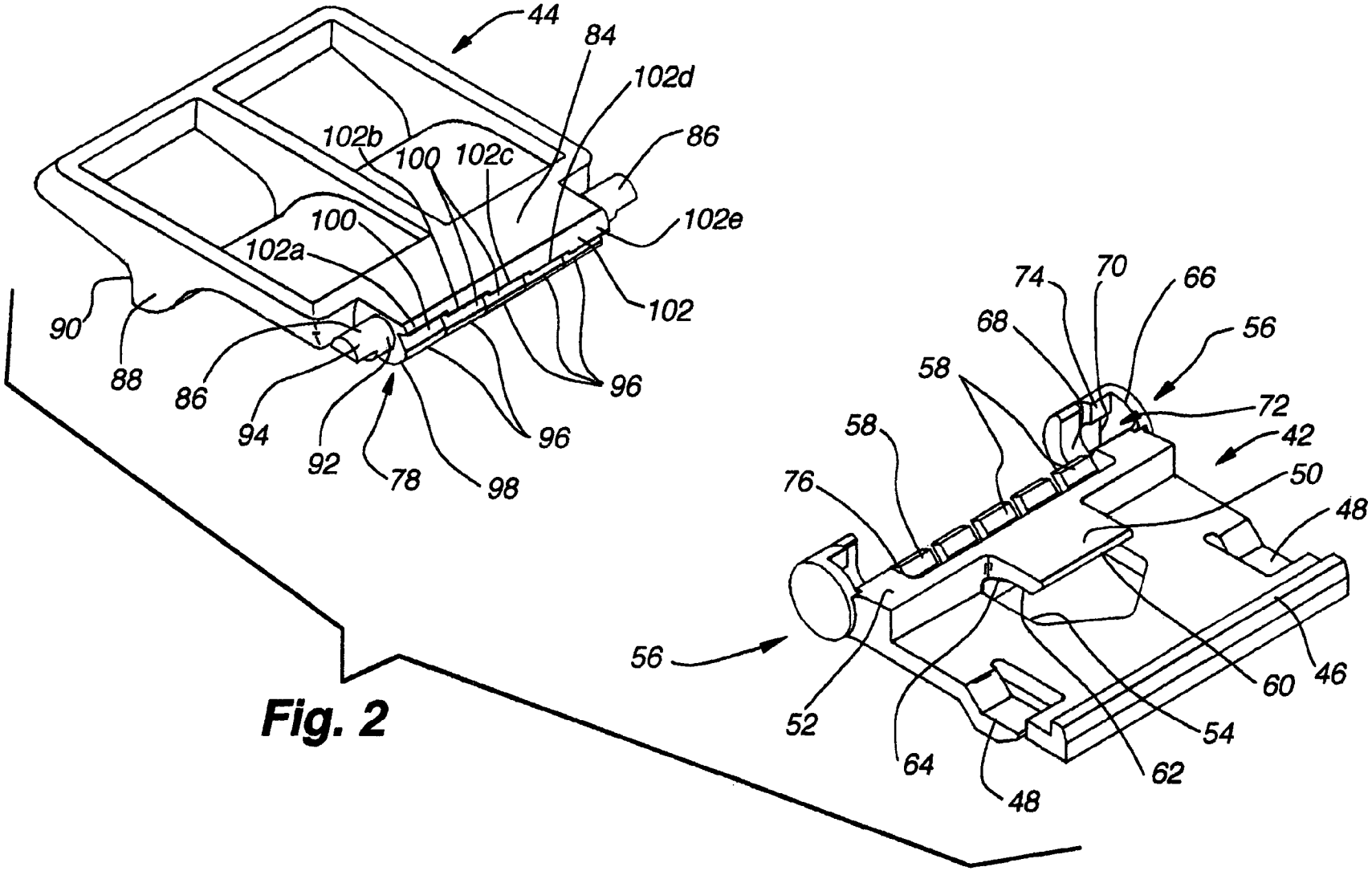
FIG. 2 is an exploded isometric of the limit stop looking at the upper sides of the limit stop.

The bearings 56 on the first element 42, probably best seen in FIG. 2, are generally cylindrical in configuration and form an extension off the rear of the raised bar 52 at opposite ends of the raised bar. Each bearing is identical and forms a mirror image of the other. The bearings include a closed end cap 66 with a generally semi-cylindrical inner portion 68 defining an entrance cavity and an outer portion 70 of slightly greater than semi-cylindrical configuration having a keyhole 72 defined thereinto by an overlying lip 74. As will be explained in more detail later, the second element 44 is adapted to be pivotally inserted into the bearings for removable retention therein and to permit selected pivotal movement.

Figure 3:
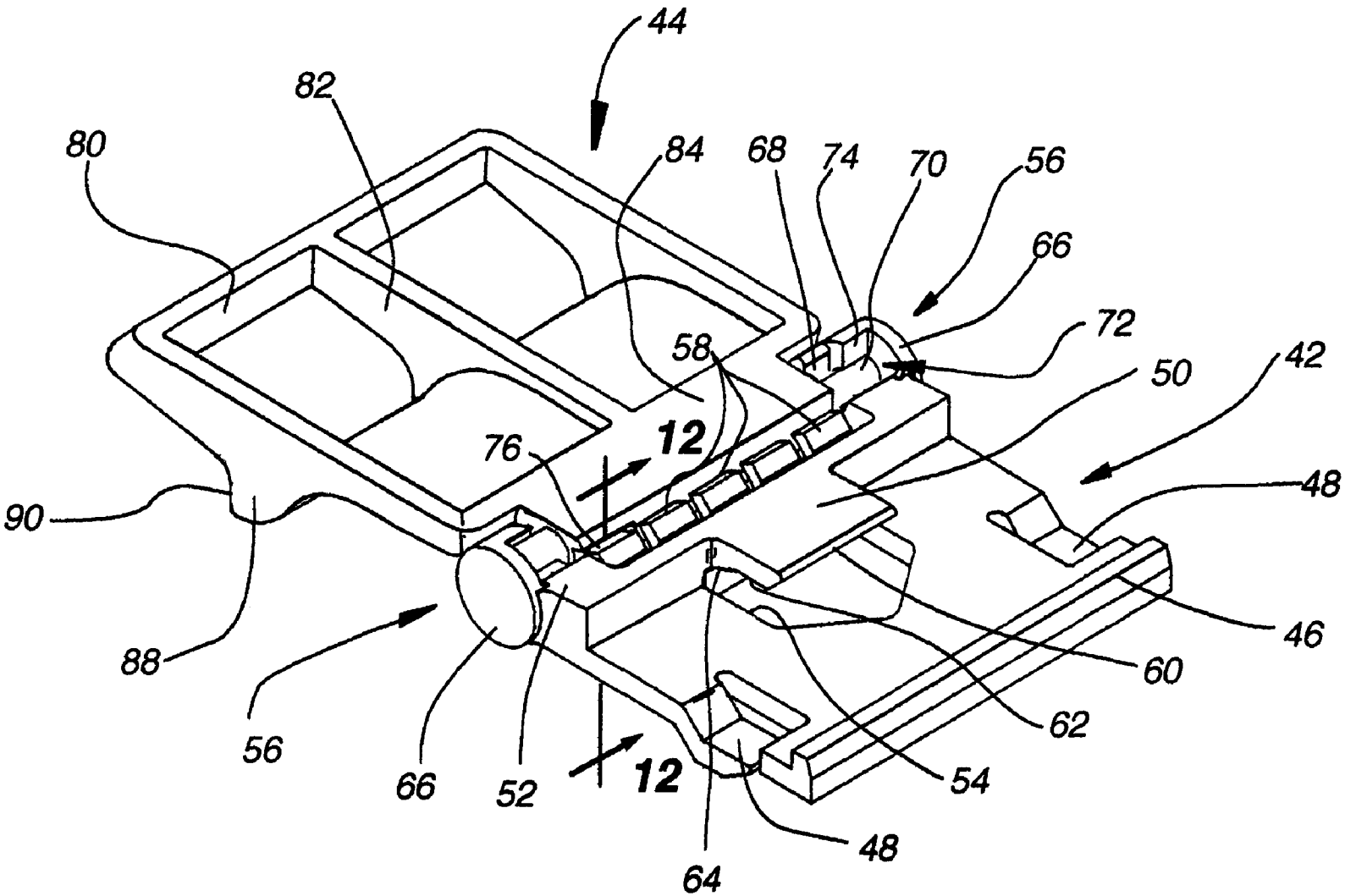
FIG. 3 is an isometric similar to FIG. 2 with the elements of the limit stop connected.
Figure 4:
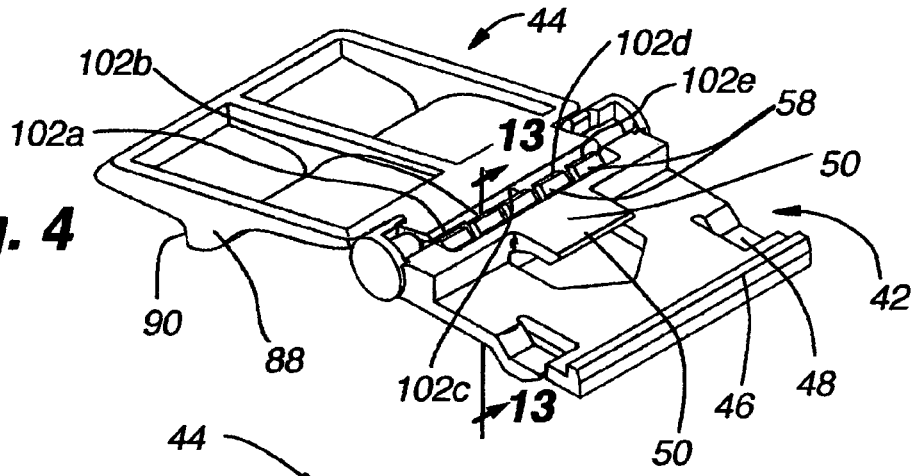
FIG. 4 is an isometric similar to FIG. 3 with the second element of the limit stop pivoted to a first selected position relative to the first element.
Figure 5:
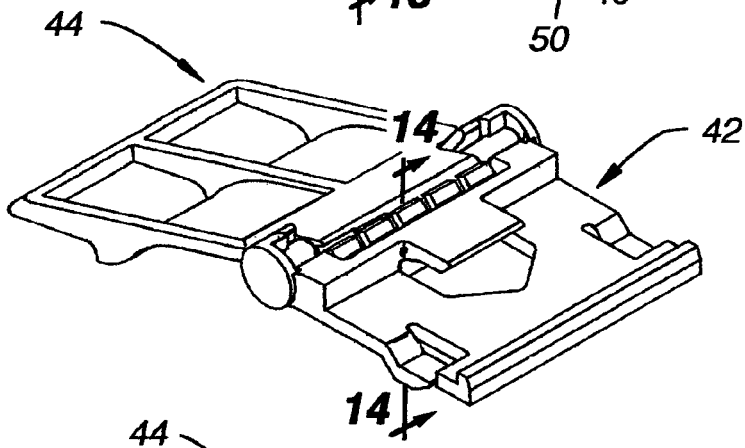
FIG. 5 is an isometric similar to FIG. 4 with the second element pivoted to a second selected position relative to the first element.
Figure 6:
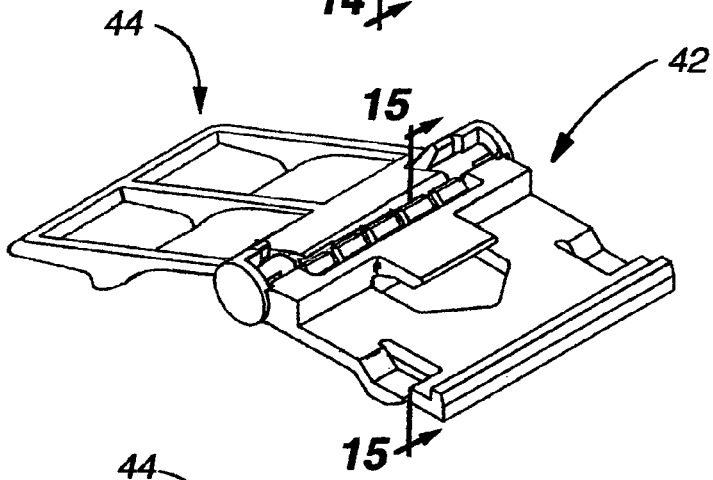
FIG. 6 is an isometric similar to FIG. 5 with the second element pivoted to a third selected position relative to the first element.
Figure 7:
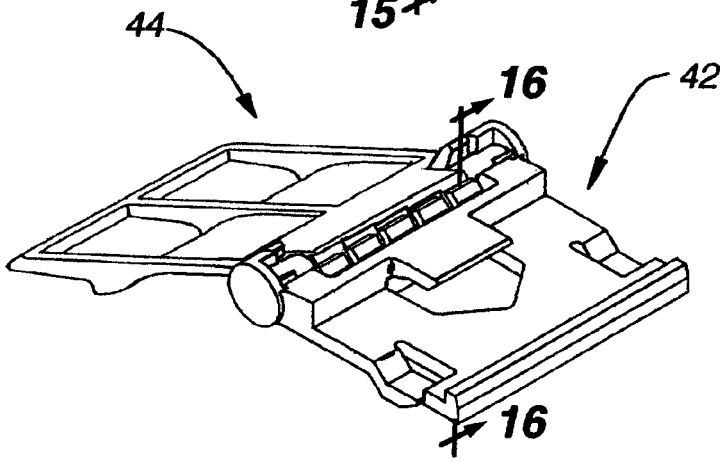
FIG. 7 is an isometric similar to FIG. 6 with the second element pivoted to a fourth fixed position relative to the first element.
Figure 8:
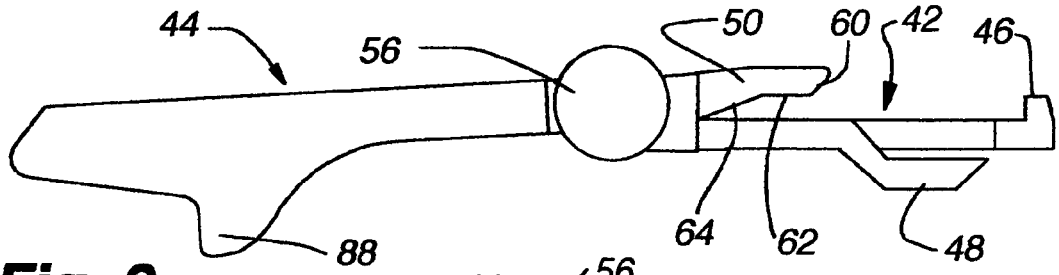
FIG. 8 is a side elevation of the limit stop.

The lock fingers 58 are spaced identical fingers having a limited degree of flexibility but being resilient so as to return to their neutral position illustrated in FIGS. 2 and 3 after having been flexed. Each finger has a generally rectangular body formed in a cavity in the rear upper side of the raised bar 52 with each finger having a flat outer edge 76. The fingers are adapted to cooperate with an indexing system 78 on the second element as will be described hereafter to permit limit pivotal movement of the second element relative to the first element and to selectively retain the second element in a predetermined angular relationship with the first element.

The second element 44 is probably best illustrated in FIG. 2 to include a main body having an upwardly directed peripheral wall 80 and a central divider 82 extending from a front to a rear wall. The front wall of the second element has a mounting bar or indexed body 84 thereon carrying the indexing system that cooperates with the flexible fingers 58 on the first element 42 as well as pivot shafts 86 that are releasably receivable in the bearings 56 of the first element. The bottom surface of the second element is curved to define an abutment stop 88 having a generally flat surface 90 that is tangentially oriented relative to an arch of revolution of the second element about the pivot shafts 86. The abutment stop is adapted to cooperate with the bottom rail 40 of the shade material in limiting retracting movement thereof as will be described later.

Figure 1B:
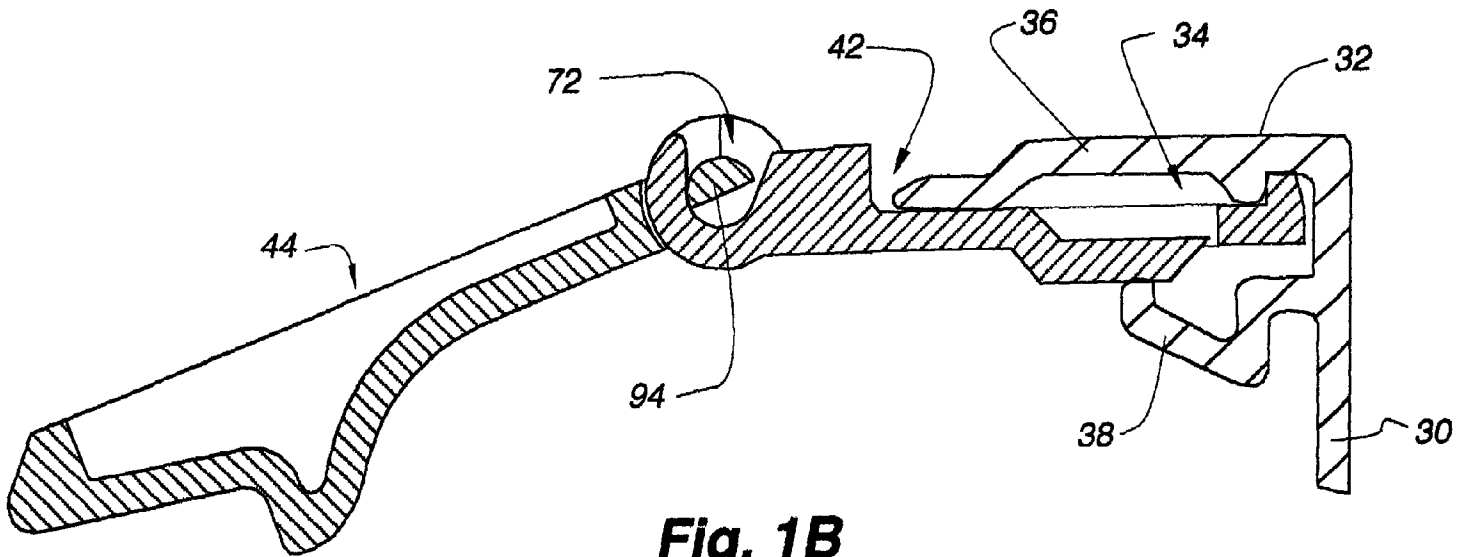
FIG. 1B is an enlarged section taken along line 1B-1B of FIG. 1.

Each pivot shaft 86 as probably best seen in FIG. 2 has a base 92 of cylindrical configuration and an outer end 94 of semi-cylindrical configuration. The semi-cylindrical configuration of the outer end, as can be seen in FIG. 1B, is adapted to fit through the keyhole 72 in the bearings of the first element to permit insertion of the pivot shafts into the bearing for pivotal movement therein.

The indexing system 78, as is also best seen in FIG. 2 is mounted in the enlarged indexed body 84 and has five discrete segments 96 corresponding and alignable with the lock fingers 58 on the first element. In other words, each segment 96 of the indexed body is horizontally aligned with a lock finger when the first and second elements are interconnected.

The indexed segments 96 have a continuous arcuate bottom wall 98 having a beveled edge 100 along the front of the segment at approximately midway between the top and bottom of the segment. A lip 102 is formed off the top of the indexed body 84 and overlies in spaced relationship the beveled edges 100 of the indexed segments 96 with the lip being of segmented thickness as possibly best seen in FIG. 2. In other words, at the left edge of the lip, as viewed in FIG. 2, the lip 102*a* is relatively thin and has progressively thicker portions 102*b*-102*e* in steps progressing to the right so there are five contiguous steps defining five thicknesses of the lip with the lip always being spaced from the beveled edge of an index segment a distance sufficient to receive a lock finger. In fact, the index segment 96 to the far left adjacent the thinnest portion 102*a* of the lip is spaced from the beveled edge a greater distance obviously than the index segment at the far right associated with the thickest portion 102*e* of the ledge. The thinnest portion 102*e* of the ledge is spaced a distance to readily accommodate the lock finger associated therewith with generous space remaining. The same is true of each of the spaces associated with the five index segments except for the last index segment 102*e*.

Figure 11A:
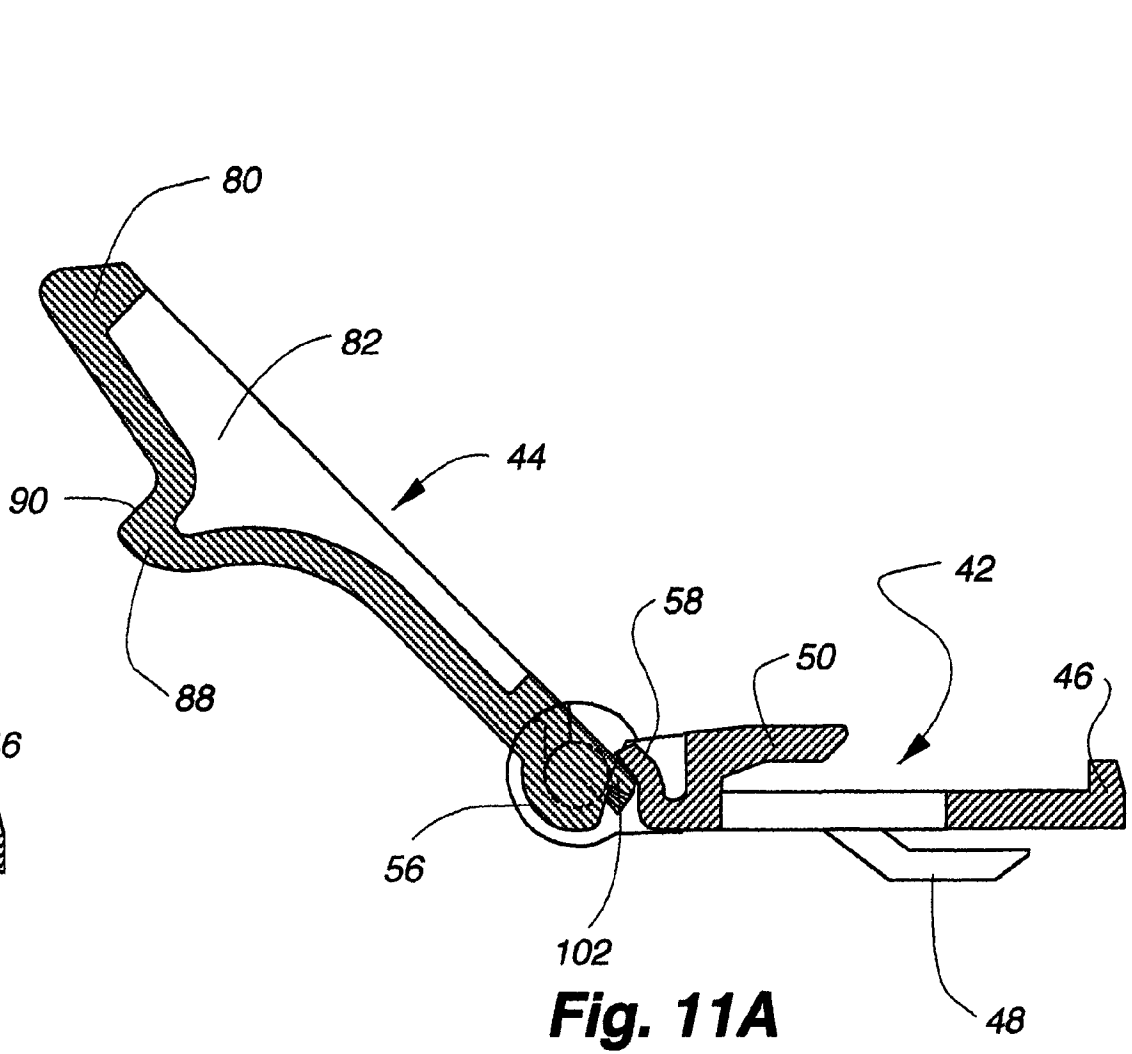
FIG. 11A is a vertical section similar to FIG. 11 with the first and second elements of the limit stop having been interconnected and the second element pivoted counterclockwise from the position illustrated in FIG. 11.
Figure 11:
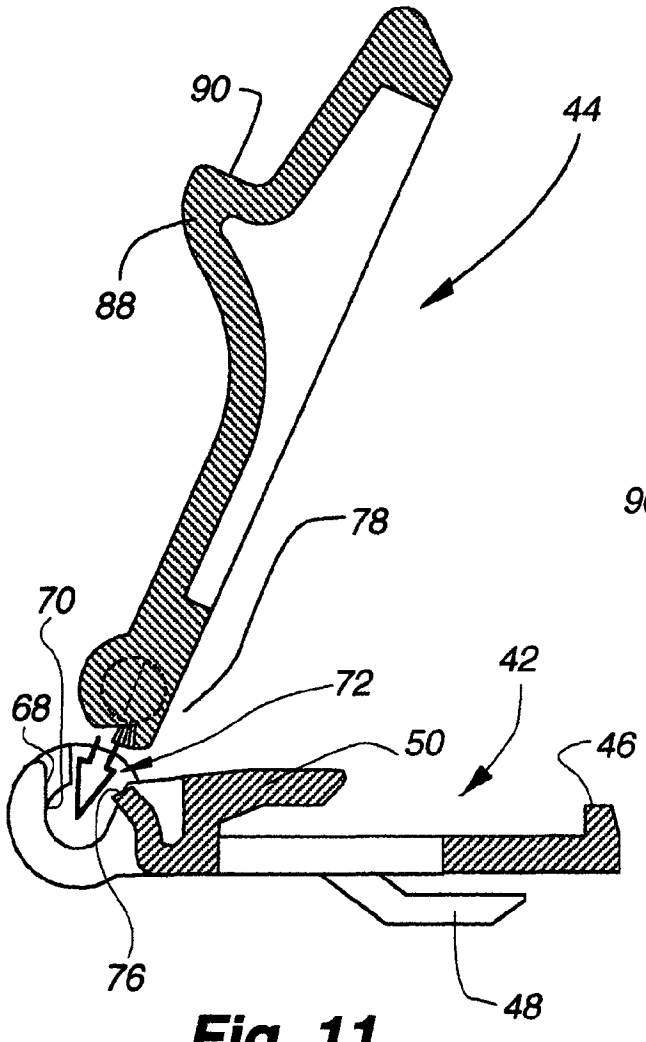
FIG. 11 is an exploded vertical section illustrating the pivotal inner connection between the first and second elements of the limit stop.

Referring to FIGS. 11 and 11A, the connection of the first 42 and second 44 elements of the limit stop 20 is illustrated. In FIG. 11, the first element is positioned on its bottom side so that the keyholes 72 in the outer end of the bearings 56 are oriented to open upwardly in a position to receive the pivot shafts 86 of the second element. The second element is oriented as shown in FIG. 11 so that the semi-cylindrical end 94 of each pivot shaft will fit through the keyed opening in the bearing and once the shaft has passed through the keyed opening, it is received (FIG. 1B) in the greater than 270° generally outer portion 70 of the bearing where the second element can be pivoted to the left or counterclockwise as seen in FIG. 11. After having pivoted the second element a small amount relative to the first element, the keyhole prevents the pivot shafts from being removed from the bearings and allows the second element to pivot relative to the first element.

The lock fingers 58 and index segments 96 cooperate in limiting pivotal movement of the second element relative to the first element between five selected positions. The five selected positions are illustrated in FIGS. 12-16 respectively.

As will be appreciated by reference to FIG. 11A, when the second element 44 has been pivoted counterclockwise so as to form a substantially 45° angle with horizontal, the lock fingers 58 all engage the top surface of the lip 102 on the second element which resists further pivotal movement. The second element is still free to pivot in a clockwise direction should one want to separate the elements in a reverse manner to that in which they were connected.

Figures 12, 13, 14:
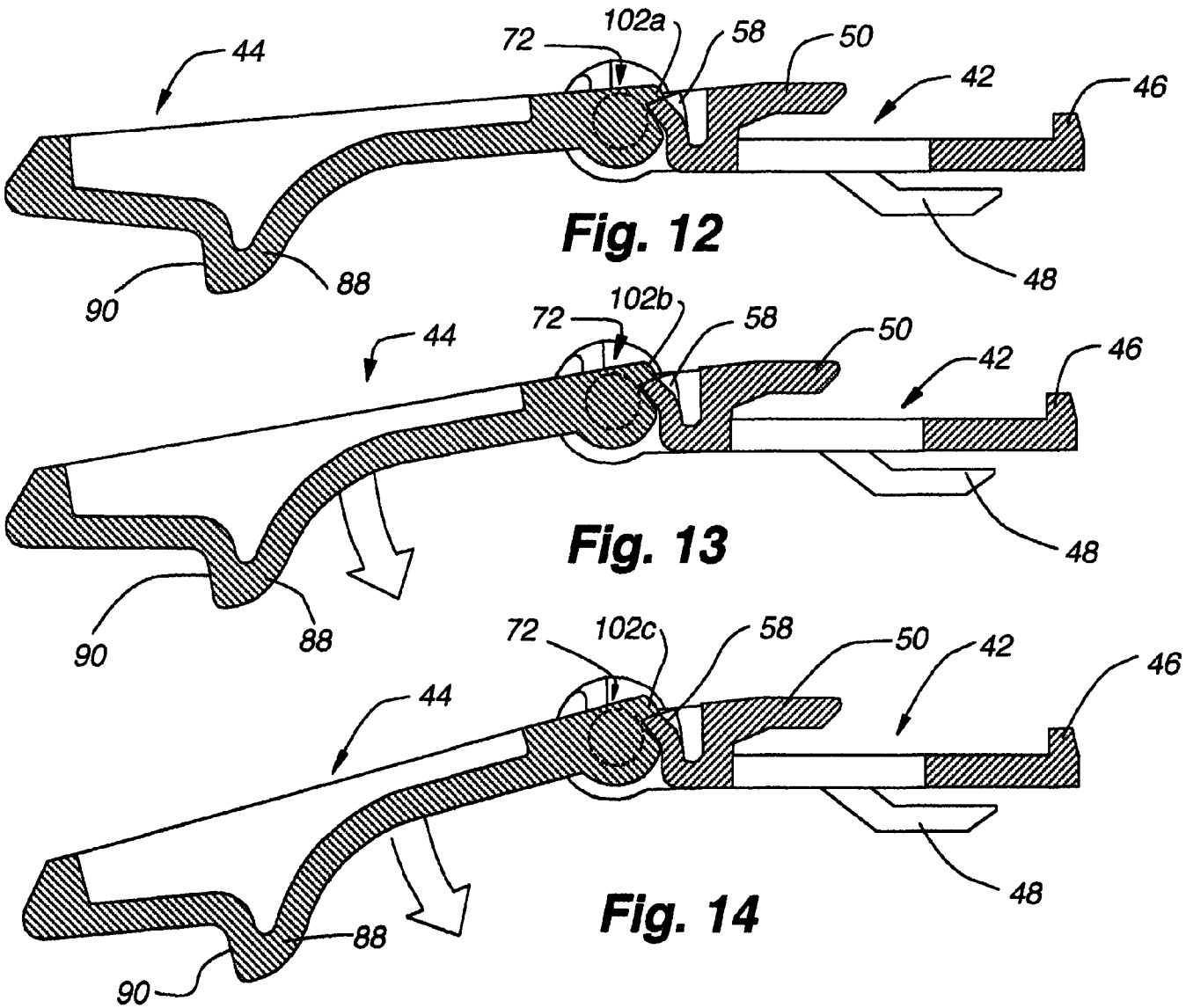
FIG. 12 is an enlarged vertical section taken along line 12-12 of FIG. 3.
FIG. 13 is an enlarged vertical section taken along line 13-13 of FIG. 4.
FIG. 14 is an enlarged vertical section taken along line 14-14 of FIG. 5.

Further counterclockwise rotation of the second element 44 relative to the first element 42 from the position of FIG. 11A to the position of FIG. 12 is resisted by the fingers engagement with the top surface of the lip 102 of the indexed body 84, but the angle or arcuate nature of the outer edge of the lip forces the fingers to flex upwardly with additional force applied to the second element as the second element continues to move counterclockwise until the first lock finger (the furthest finger to the left as viewed in FIG. 2) passes beyond the first portion 102*a* of the lip which of course as mentioned previously is thinner than the remaining four portions 102*b*-102*e* of the lip. FIG. 12 illustrates the relationship of the first and second segments after the first lock finger has snapped beneath the lip 102*a* of the indexed body and is trapped in the space between the lip and the underlying beveled edge of the aligned index segment 96. As will be appreciated in FIG. 12, the remaining fingers 58 can be seen still flexed upwardly as they remain in engagement with the relatively thick portions of the lip. When the second element has been positioned as illustrated in FIG. 12, it will be appreciated it cannot be rotated counterclockwise due to the abutment of the lip 102*a* with the edge of the first lock finger and further counterclockwise rotation is resisted by the fingers engagement with the lip of the indexed body 84 even though this resistance can be overcome with manual force.

Referring to FIG. 13, the second element 44 has been further pivoted in a counterclockwise direction beyond the position of FIG. 12 into a position wherein the second lock finger 58 from the left as viewed in FIG. 2 has snapped beneath the relatively thicker portion 102*b* of the lip so that it too resides in a rest position with a gap defined between the lip 102*b* and the beveled edge of the index segment 96 associated therewith. Again, clockwise pivotal movement of the second element relative to the first element 42 is prohibited by the first and second lock fingers engagement with the overlying lip 102 but further counterclockwise movement is obtainable even though resisted by the lock fingers engagement with the lip.

Figure 15:
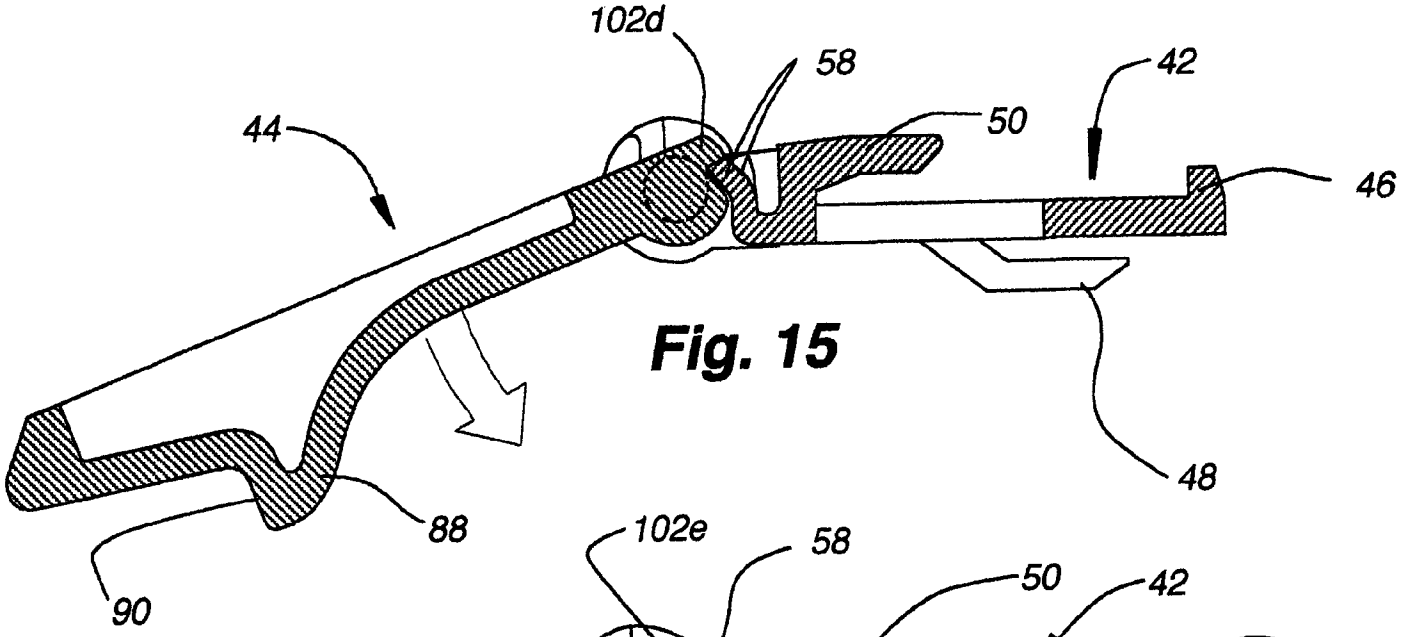
FIG. 15 is an enlarged vertical section taken along line 15-15 of FIG. 6.
Figure 16:
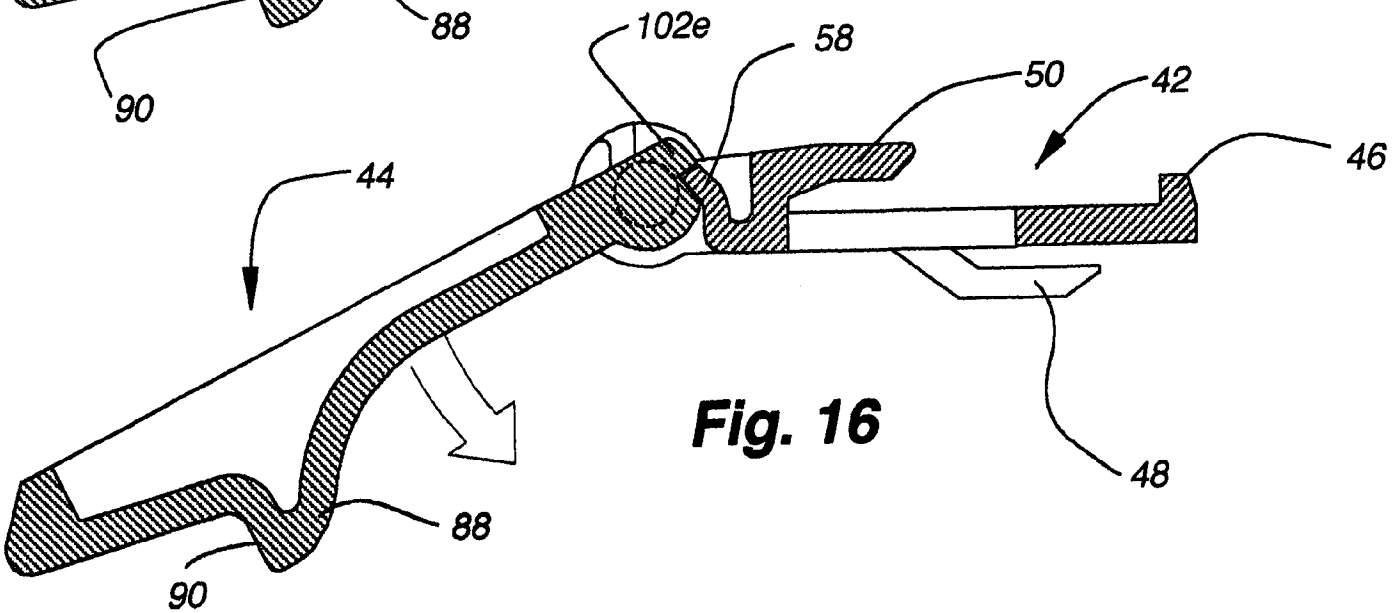
FIG. 16 is an enlarged vertical section taken along line 16-16 of FIG. 7.

FIGS. 14-16 illustrate three additional sequential positions wherein the third, fourth, and fifth fingers 58, respectively, have snapped beneath the increasingly thick associated lip portions 102*c*-102*e* of the indexed body 84 associated with those fingers. It will therefore be appreciated that the second element can be positioned in any one of five selected positions between a generally coplanar relationship of the first and second elements as illustrated in FIG. 12 to an angled relationship of approximately 24° as shown in FIG. 16. The indexes in the limit stop 20 of the described embodiment have 5.5° angular differences so that each of the five positions is separated by 5.5°.

The importance of being able to adjust the relative angular relationship between the second element and the first element is probably best illustrated by reference to FIGS. 9 and 10 wherein FIG. 9 illustrates a roll of shade material 24 that is relatively thick due to the length of the shade material and FIG. 10 shows a roll of shade material 24 that is relatively thin due to a shorter length than that of the shade material of FIG. 9. As will be appreciated, the second element 44 is positioned in FIG. 9 in a position corresponding with that of FIG. 12 so that the second element projects substantially horizontally away from the first element 42 and the abutment stop 88 is spaced a slight distance from the outer wrap of the shade material when the shade material is fully wrapped into its retracted position as illustrated in FIG. 9. As will be appreciated, in this position, the bottom rail 40 of the shade material is engaged with the abutment stop which terminates further counterclockwise rotation of the roller 26 and thus terminates a wrapping motion.

If the wrap of shade material 24 is thinner as illustrated in FIG. 10, the second element might be positioned at an angle corresponding to FIG. 15, for example, so that the abutment stop 88 is again closely spaced from the outer wrap of shade material and in a position to interrupt rotating movement of the bottom rail 40 when the shade is fully retracted.

In adjusting the limit stop 20, it will be appreciated that it is easily connectible to the rear edge of the headrail 28 so that the second element 44 is projecting horizontally and rearwardly over the roll of shade material 24. The roll is then moved to its fully retracted position and the second element is depressed manually with finger pressure to sequentially index the second element relative to the first element 42 into one of the five positions of FIGS. 12-16 and principally the position wherein the abutment stop 88 on the second element is slightly spaced from the outer wrap of shade material but in a position to intercept the bottom rail 40 when the shade material is being retracted.

From the above, it will be appreciated that a limit stop has been described, which is easily mounted on a headrail and selectively positioned to intercept the bottom rail of a shade material without interfering with the shade material itself as it is wrapped or unwrapped from a roller in the covering. This arrangement is reliable in operation, is easily installed, and avoids damage to the shade material which has been prevalent in prior art designs.

Although the present invention has been described with a certain degree of particularity, it is understood the present disclosure has been made by way of example, and changes in detail or structure may be made without departing from the spirit of the invention as defined in the appended claims.

The invention claimed is:

1. A system for limiting retracting movement of a roller in a covering for an architectural opening comprising in combination:

a headrail;

a roller mounted in said headrail for reversible rotating movement between extended and retracted positions, said roller having a flexible shade material mounted thereon so as to be wrappable about said roller in said retracted position and unwrapped from said roller in said extended position, said shade material having a first edge connected to said roller and a second opposite free edge having a bottom rail thereon, and an adjustable stop mounted on said headrail, said stop including a first element secured to said headrail and a second element pivotally mounted on said first element, an indexing system on said stop for selectively limiting pivotal movement of said second element relative to said first element and for permitting a plurality of preselected fixed relationships between said first and second elements, said second element including an abutment stop adapted to overlie said roller without engaging the shade material on said roller and engage said bottom rail to prevent rotation of said roller in one direction upon said roller being positioned in said retracted position.

2. The system of claim 1 wherein said indexing system includes a plurality of index portions of differing dimension laterally adjacent to each other on one of said elements and a plurality of aligned fingers on the other of said elements adapted to engage said portions at a predetermined angular relationship between said elements.

3. The system of claim 2 wherein said fingers are somewhat rigid but flexible, at least one of which is adapted to snap past an aligned portion on relative pivotal movement between said elements in one direction.

4. The system of claim 3 wherein individual fingers snap past an associated aligned portion at different angular relationships of said elements.

5. The system of claim 4 wherein said fingers snap past said portions in said one direction of pivotal movement of said elements to permit further pivotal movement in said one direction but engage said portions to prevent pivotal movement of said elements in an opposite direction after having been snapped past an aligned portion.

6. The system of claim 5 further including index segments which are arcuate in configuration with each index segment being aligned and spaced from an indexed portion of a different dimension than the other portions and wherein said fingers slide along said portions in pivotal movement of said elements in said first direction and snap past said portions as said fingers become disengaged from said portions.

7. The system of claim 6 wherein individual ones of said fingers become disengaged from an aligned portion at different angular relationships of said elements.

* * * * *